US005960241A

United States Patent [19]

Yoshida

[11] Patent Number: 5,960,241

[45] Date of Patent: Sep. 28, 1999

[54] COLOR IMAGE FORMING DEVICE AND IMAGE TRANSFER POINT DECIDING METHOD IN THE SAME

[75] Inventor: Hiroaki Yoshida, Kawasaki, Japan

[73] Assignee: Fujitsu Limited, Kawasaki, Japan

[21] Appl. No.: 08/748,663

[22] Filed: Nov. 14, 1996

[30] Foreign Application Priority Data

Dec. 22, 1995 [JP] Japan ..... 7-335531

[51] Int. Cl.[6] ..... G03G 15/01

[52] U.S. Cl. ..... 399/299; 399/298; 399/300

[58] Field of Search ..... 399/297, 298, 399/299, 300, 301, 303, 318

[56] References Cited

U.S. PATENT DOCUMENTS

| | | | |
|---|---|---|---|
| 4,796,050 | 1/1989 | Furuta et al. | 399/299 X |
| 5,119,139 | 6/1992 | Torisawa | 399/299 |
| 5,296,897 | 3/1994 | Amemiya et al. | 399/301 X |
| 5,309,203 | 5/1994 | Hokari | 399/303 |
| 5,365,324 | 11/1994 | Gu et al. | 399/299 |
| 5,469,248 | 11/1995 | Fujiwara et al. | 399/298 X |
| 5,541,634 | 7/1996 | Otsuka et al. | 399/299 X |
| 5,581,327 | 12/1996 | Izumizaki et al. | 399/299 X |

FOREIGN PATENT DOCUMENTS

| | | |
|---|---|---|
| 32 23 639 A1 | 1/1983 | Germany . |
| 44 33 152 A1 | 5/1995 | Germany . |
| 06289732 | 10/1994 | Japan . |

*Primary Examiner*—Sandra L. Brase
*Attorney, Agent, or Firm*—Armstrong, Westerman, Hattori, McLeland & Naughton

[57] ABSTRACT

A color image forming device that can suppress the occurrence of a transfer positional shift due to a variation in velocity of the drive system as low as possible even when the distance between image transfer points of each color varies. In the color image forming device, after a position of a first image transfer point and the position of the second image transfer point are decided so that the distance between the first image transfer point and the second image transfer point is equal to an integral multiple of a reference length corresponding to the velocity variation period of the drive system, positions of image transfer points on the lower side than the second image transfer point are sequentially decided from the upper side of the conveying path according to the following procedures. The temporary position of an i (≧3) -th image transfer point is decided. A shortest conveying path is decided for each of the first to i-th or (i−1)-th image transfer points, among conveying paths which extend from each of the first to (i−1)-th image transfer point to the temporary position. A position of a point near the temporary position which the shortest conveying path from each of the first to (i−1)-th image transfer points reaches is decided so that the shortest coneying path length is equal to an integral multiple of the reference length. The position of the i-th image transfer point is decided based on the positions of the (i−1) points obtained. The color image forming device is applicable to printers of electro-photographic system or electrostatic recording system.

6 Claims, 7 Drawing Sheets

COLOR IMAGE FORMING DEVICE AND IMAGE TRANSFER POINT DECIDING METHOD IN THE SAME

BACKGROUND OF THE INVENTION

1) Field of the Invention

The present invention relates to a device that has plural printing units each including photosensitive bodies and that forms a color image on a sheet-like medium by overlapping sequentially different colors on the sheet-like medium in the printing units.

2) Description of the Related Art

Electro-photographic printers as color image forming devices, for example, have generally the structure as shown in FIG. 6. The electro-photographic printer 1 consists of a color printing engine 2, sheet cassettes 3 and 4, a sheet feeding unit 5, a sheet ejecting unit 6, a sheet stacker 7, a power supply/control unit 8, and others.

In the electro-photographic printer 1, transfer paper sheets (sheet-like medium) 18 to be printed are stored in the sheet cassettes 3 and 4. At a printing operation, a sheet of transfer paper sheet 18 is sent out of the sheet feeding unit 5 and then guided by means of a conveying roller 23 along a conveying guide (conveying path) 24 to the color printing engine 2. The transfer paper sheet 18 color-printed by the color printing engine 2 (to be described later) is guided by means of the conveying roller 23 via the conveying guide (conveying path) 24 and the sheet ejecting unit 6 and then ejected into the sheet stacker 7.

The power supply/control unit 8 has the function of distributing electric power for the operation of the printer 1 to various portions and controlling the whole operation of the printer 1 including the printing operation of the color printing engine 2.

The printer 1 shown in FIG. 6 includes a double-sided surface mechanism (not shown) that reverses the transfer paper sheet 18 with one surface printed on the side of the sheet ejecting unit 6 to perform a double-sided surface printing on the transfer paper sheet 18 and a conveying guide (conveying path) 24A that again sends the transfer paper sheet 18 reversed by the double-sided surface mechanism to the color printing engine 2.

Generally speaking, the color printing engine 2 for a color printing operation has four printing units 10Y, 10M, 10C, and 10K, a fixing unit 16, an endless transfer belt (a conveying belt such as an electrostatic adsorption belt) 17 made of a resin which conveys the transfer paper sheet 18.

The printing unit 10Y is formed of a photosensitive body (transfer drum, latent image carrier) 11, a pre-charger 12, an optical unit 13, a developing unit 14, and a transfer roller 15 in order to transfer a toner image (developed image) of yellow (Y) on the transfer paper sheet 18. The printing unit 10M is formed of a photosensitive body (transfer drum, latent image carrier) 11, a pre-charger 12, an optical unit 13, a developing unit 14, and a transfer roller 15 in order to transfer a toner image (developed image) of magenta (Z) on the transfer paper sheet 18. The printing unit 10C is formed of a photosensitive body (transfer drum, latent image carrier) 11, a pre-charger 12, an optical unit 13, a developing unit 14, and a transfer roller 15 in order to transfer a toner image (developed image) of cyan (C) on the transfer paper sheet 18. The printing unit 10K is formed of a photosensitive body (transfer drum, latent image carrier) 11, a pre-charger 12, an optical unit 13, a developing unit 14, and a transfer roller 15 in order to transfer a toner image (developed image) of black (B) on the transfer paper sheet 18. The printing units 10Y, 10M, 10C and 10K are arranged nearly in parallel along the transfer belt 17.

The photosensitive body 11 is rotatably driven by means of a drive motor (not shown). The pre-charger 12 charges evenly the surface of the photosensitive body 11. The optical unit 13 projects an image light corresponding to recording information (information regarding print data) on the surface of the photosensitive body 11. The optical unit 13 exposes a pattern corresponding to print data on the surface of the photosensitive body 11 to form an electrostatic latent image.

The developing unit 14 develops an electrostatic latent image formed on the surface of the photosensitive body 11. In fact, the developing process is performed by supplying toner on the surface of the photosensitive body 11 and then forming a toner image (latent image, developing image) being a visual image. The transfer rollers 15 are arranged so as to confront the photosensitive bodies 11 via the transfer belt (or the transfer paper sheet 18) 17. The toner image on the photosensitive body 11 is transferred onto the transfer paper sheet 18 at a transfer point 25 by sandwiching the transfer paper sheet 18 conveyed by the transfer belt 17 at the image transfer point 25 between the transfer roller 15 and the photosensitive body 11.

Further, when the transfer paper sheet 18 on which a toner image of each color is transferred by means of the printing units 10Y, 10M, 10C and 10K is conveyed, the fixing unit 16 fixes the toner image formed on the transfer paper sheet 18 onto the transfer paper sheet 18 by heat, pressure, light, or the like.

The transfer belt 17 is endlessly wound around the drive roller 19, the follower roller 20, and tensioning rollers (tensioners) 21 and 22, and is driven by transmitting the rotational drive force of a drive motor (not shown) from the drive roller 19. The transfer paper sheet 18 which is electrically charged by means of a charger (not shown) is electrostatistically adsorbed on the outer surface (the surface confronting the photosensitive body 11) and then is conveyed sequentially to the printing units 10Y, 10M, 10C and 10K.

In order to arrange in order the ends of transfer paper sheets 18, a resist roller (not shown) is arranged just in front of the image transfer point 25 to the transfer paper sheet 18 in each of the printing units 10Y, 10M, 10C and 10K.

In the electro-photographic printer 1 with the above-mentioned structure shown in FIG. 6, the transfer paper sheet 18 is fed from the sheet cassette 3 or 4 onto the transfer belt 17 of the color printing engine 2 via the sheet feeding unit 5. Then the transfer paper sheet 18 is transferred by means of the transfer belt 17 and then is fed to the fixing unit 16 after passing through the printing units 10Y, 10M, 10C and 10K.

When the transfer paper sheet 18 passes through the printing units 10Y, 10M, 10C and 10K, a toner image of each color (Y, M, C, K) is transferred onto the transfer paper sheet 18. When the transfer paper sheet 18 passes through the fixing unit 16, the toner image is fixed on the transfer paper sheet 18.

When a printing operation is carried out by overlaying sequentially different colors on the transfer paper sheet 18 in the printing units 10Y, 10M, 10C and 10K, a color image is formed on the transfer paper sheet 18.

In the electro-photographic printer 1 above-described, if the drive roller 19 for the transfer belt 17 and drive gears in the drive system (not shown) for driving the drive roller 19 are eccentrically arranged, the velocity of the transfer belt 17 varies. This velocity variation is unavoidable even when the drive roller 19 and the drive system are fabricated accurately.

As shown in FIG. 7, the velocity variation has usually its fixed periodicity in which one revolution of the drive roller 19 is one period. The same velocity variation is repeated every time the drive roller 19 rotates once.

The velocity variation may delicately shift the transfer position of an toner image in each of the printing units 10Y, 10M, 10C and 10K when the photosensitive body 11 and the transfer roller 15 transfer a toner image on the same transfer paper sheet 18 in each of the printing units 10Y, 10M, 10C and 10K. Particularly, in the device that forms a color image by overlapping plural colors, the above-mentioned delicate positional shift causes color separation, thereby deteriorating the print quality of a color image.

It has been proposed that an internal (transfer interval) L between the image transfer points 25 to the transfer paper sheet 18 is set to an integral multiple of the peripheral length $\pi d$ (where d is a diameter of the drive roller) of the drive roller 19. That is, even when the velocity variation with the periodicity shown in FIG. 7 occurs, the phase of the velocity variation is equalized at the event the same transfer paper sheet 18 reaches the image transfer point in each of the printing units 10Y, 10M, 10C and 10K, with the transfer interval L set to an integral multiple of the peripheral length $\pi d$ of the drive roller 19. Thus, it can be prevented that the transfer position of the toner image shifts at each image transfer point in the same transfer paper sheet 18.

Strictly speaking, the period of the velocity variation of the transfer roller 19 does not correspond to the peripheral length $\pi d$ of the drive roller 19, but corresponds to the peripheral length $\pi(d+2t)$ of the virtual circle 26 considering a thickness t of the transfer belt 17 wound around the drive roller 19. Hence, it can be prevented more surely that the transfer position of a toner image shifts at each image transfer point by setting the transfer interval L to an integral multiple of the peripheral length $\pi(d+2t)$ of the virtual circle 26. This art is disclosed in Japanese Laid-open Patent Publication (Tokkai-Sho) No. 64-31173.

As described above, in the printer 1 that forms a color image by overlapping four colors in the printing units 10Y, 10M, 10C and 10K, all the printing units 10Y, 10M, 10C and 10K are always operated even in the monochrome printing operation. Here, the photosensitive body 11 in the printing unit with a small use frequency is wasted while the developer used in the printing unit is deteriorated. As a result, the serviceable life of the printing unit with a small use frequency is shortened.

Waste electric power is consumed by operating simultaneously printing units unused. Further, the toner left on the photosensitive body 11 in an unused printing unit stains the transfer paper sheet 18, thereby adversely affecting the print quality.

For the countermeasures, the color image forming device is proposed in which each of the transfer rollers 15 is movably arranged vertically (in the direction separating from the photosensitive body 11 or contacting with the photosensitive body 11) and all the image transfer points are arranged so as to form a slow arc (convexity) when all the printing units 10Y, 10M, 10C and 10K are used. In other words, in each of the printing units 10Y, 10M, 10C and 10K, the photosensitive body 11 and the transfer roller 15 are arranged in parallel so as to have a different height to the horizontal plane while the conveying route (or the transfer belt 17) for the transfer paper sheet 18 is formed like an arc.

In the printing unit for the above-mentioned color image forming device corresponding to an unused color component, the transfer paper sheet 18 can be separated from the photosensitive body 11, together with the transfer belt 17, by moving the transfer roller 15 using a predetermined mechanism in the direction (downward) such that it separates from the photosensitive body 11. Thus, the transfer paper sheet 18 can be set so as not to be contacted with the photosensitive body 11.

With the transfer belt 17 arranged in an arc form, when the transfer belt 17 is separated from the photosensitive body 11 by descending the transfer roller 15 in an unused printing unit, the conveying route between the image transfer points of printing units arranged before and after the unused printing unit changes from an arc into straight line.

Since the conveying route varies from an arc to a straight line when the transfer interval L between the adjacent printing units 10Y, 10M, 10C and 10K is set to an integral multiple of the peripheral length $\pi d$ or $\pi(d+2t)$ of the drive roller 19, the transfer interval between the printing units arranged after and before the unused printing unit becomes short, thereby not agreeing with an integral multiple of the peripheral length $\pi d$ or $\pi(d+2t)$.

For that reason, when a printing operation is carried out using all the printing units 10Y, 10M, 10C and 10K, the transfer positional shift may not occur. However, when part of the printing units 10Y, 10M, 10C and 10K is used for printing, with the transfer roller 15 of an unused printing unit descended, a transfer positional shift occurs due to a velocity variation. As a result, the resultant color shift causes a deterioration in print quality of a color image.

SUMMARY OF THE INVENTION

The present invention is made to overcome the above mentioned problems. An object of the present invention is to provide a color image forming device that can reduce the occurrence of a color shift by suppressing the transfer positional shift due to variations in velocity of the drive system as low as possible even when the transfer interval between plural printing units varies in a used or unused state while aiming at realizing the prolonged serviceable life of a printing unit which is not very frequently used, the reduction of power consumption and the prevention of dirt due to residual toner, so that the print quality of a color image can be reserved.

Another object of the present invention is to provide an image transfer point deciding method in a color image forming device that can reduce the occurrence of a color shift by suppressing the transfer positional shift due to variations in velocity of the drive system as low as possible even when the transfer distance between plural printing units varies in a used or unused state while aiming at realizing the prolonged serviceable life of a printing unit which is not very frequently used, the reduction of power consumption and the prevention of dirt due to residual toner, so that the print quality of a color image can be reserved.

In order to achieve the above objects, according to the present invention, the color image forming device is characterized by plural printing units for performing printing of each color on a sheet-like medium by transferring a developed image onto the sheet-like medium at an image transfer point to form a color image on the sheet-like medium by overlapping plural colors; and conveying mechanism for conveying the sheet-like medium along the conveying path continuously formed so as to pass through the image transfer points in the plural printing units, to perform a continuous printing operation onto the sheet-like medium in each of the printing units; each of the printing units including a switching mechanism which switches a state of each of the printing units to a contact state in which the printing unit performs printing at the image transfer point, while being in contact with the sheet-like medium, or to a separation state in which the printing unit does not perform printing, while the sheet-like medium being separated off from the image transfer point, together with the conveying path; a first image transfer point and a second image transfer point on the upper side of the conveying path being arranged so that the conveying path length between the first image transfer point and the second image transfer point is equal to an integral multiple of a reference length corresponding to a velocity variation period of a drive system in the conveying mechanism; and each of image transfer points of the conveying path on the lower side than the second image transfer point being arranged to positions sequentially decided according to the following procedures (1) to (4) from the upper side of the conveying path.

(1) deciding a temporary position or arrangement area of an i (≧3) -th image transfer point from the upper side of the conveying path;

(2) deciding the conveying path most-shortened according to the contact or separation state switched by the switching mechanism for the first to (i−1)-th image transfer points, among conveying paths which extend from the first to (i−1)-th image transfer points to the temporary position or the arrangement area;

(3) deciding a position of a point near the temporary point or within the arrangement area which the shortest conveying path from each of the first to (i−1)-th image transfer points obtained in the step (2) reaches so that the shortest conveying path length is equal to an integral multiple of the reference length; and (4) deciding the position of the i-th image transfer point based on the positions of the (i−1) points obtained in the step (3).

In this case, the conveying mechanism may be formed of a conveying belt which is driven by means of a drive roller while the sheet-like medium is mounted thereon, and the reference length may be a peripheral length of the drive roller.

The conveying mechanism may be formed of a conveying belt which is driven by means of a drive roller while the sheet-like medium is mounted thereon, and the reference length may be $\pi(d+2t)$, where d is a diameter of the drive roller and t is a thickness of the conveying belt.

As described above, according to the color image forming device and the image transfer point deciding method for the color image forming device, even if the transfer interval between plural printing units in a used or unused state varies, the position of the image transfer point in each printing unit is decided so as to suppress the occurrence of the transfer positional shift accompanying the velocity variation of the drive system as low as possible, whereby the image transfer point is arranged at the position. Hence, the present invention has the advantage of suppressing the occurrence of a color shift and ensuring the print quality of a color image, with color shift occurrence reduced, by aiming at realizing the prolonged serviceable life of a printing unit which is not very frequently used, the reduction of power consumption and the prevention of dirt due to residual toner.

DESCRIPTION OF THE PREFERRED EMBODIMENTS

Let us explain an embodiment of the present invention with reference to the attached drawings.

Figure 1:
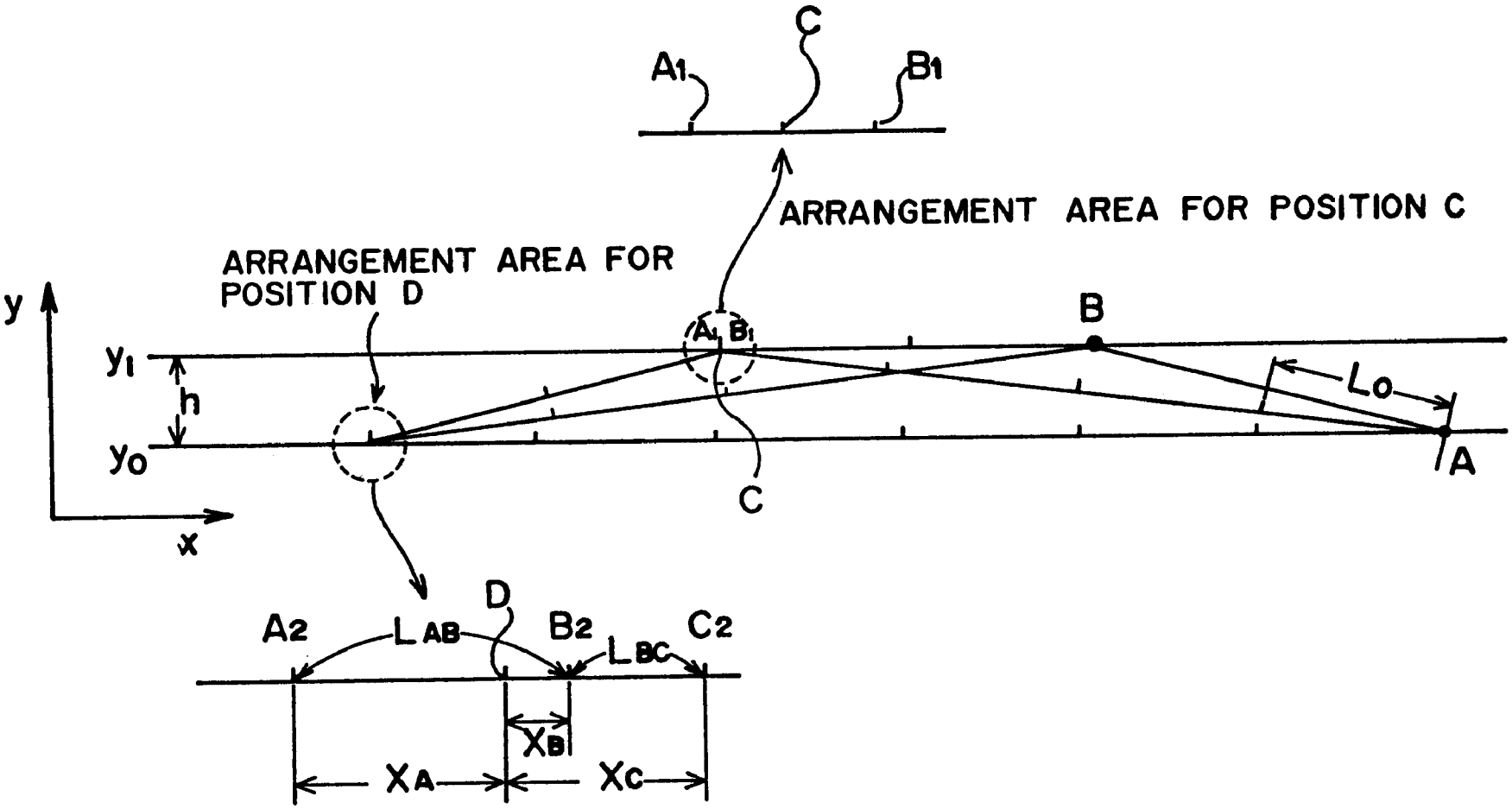
FIG. 1 is a diagram used for explaining the image transfer point deciding method in a color image forming device according to an embodiment of the present invention.
Figure 2:
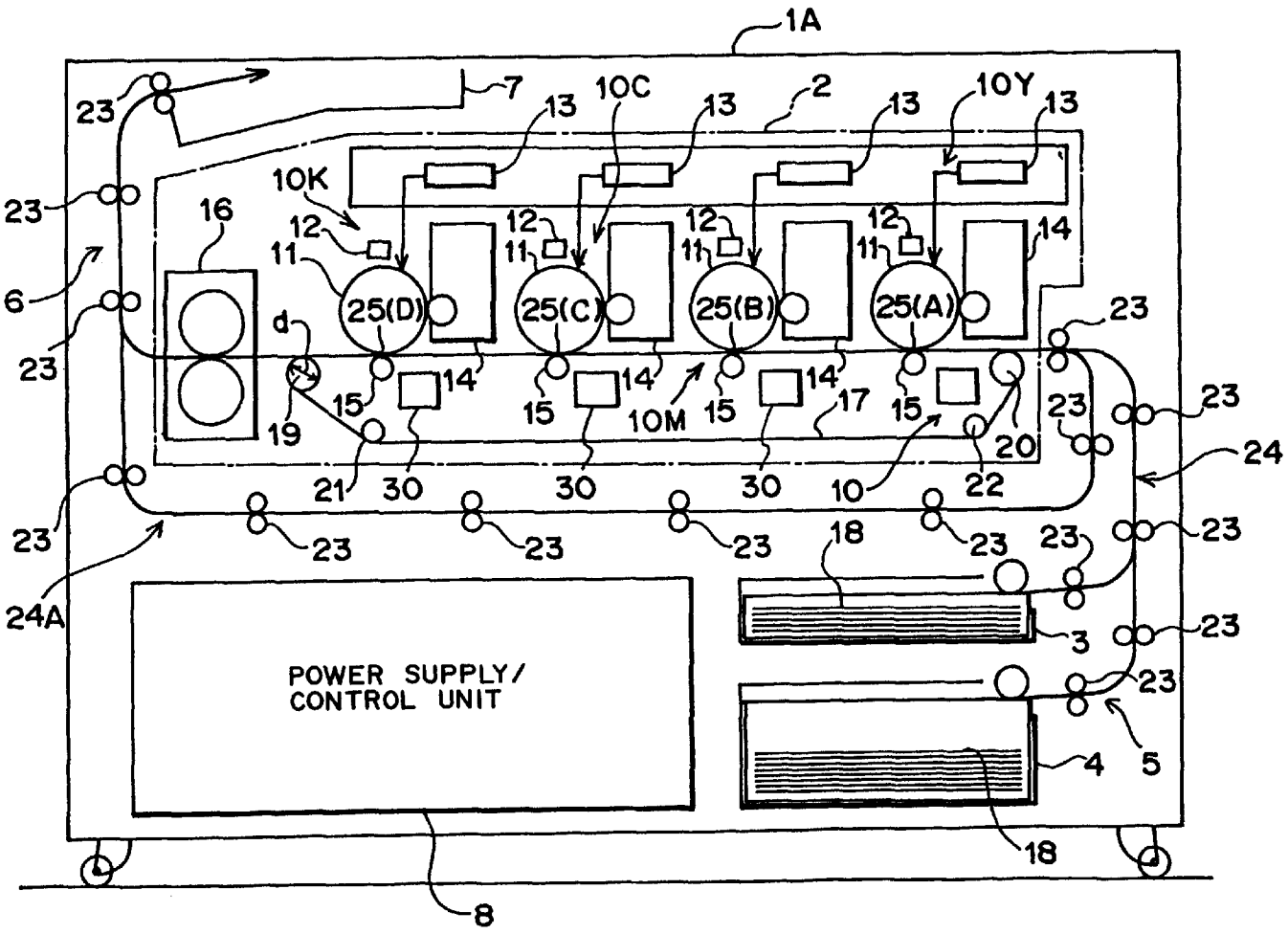
FIG. 2 is a side sectional view schematically showing the internal structure of a color image forming device according to an embodiment of the present invention.
Figure 3:
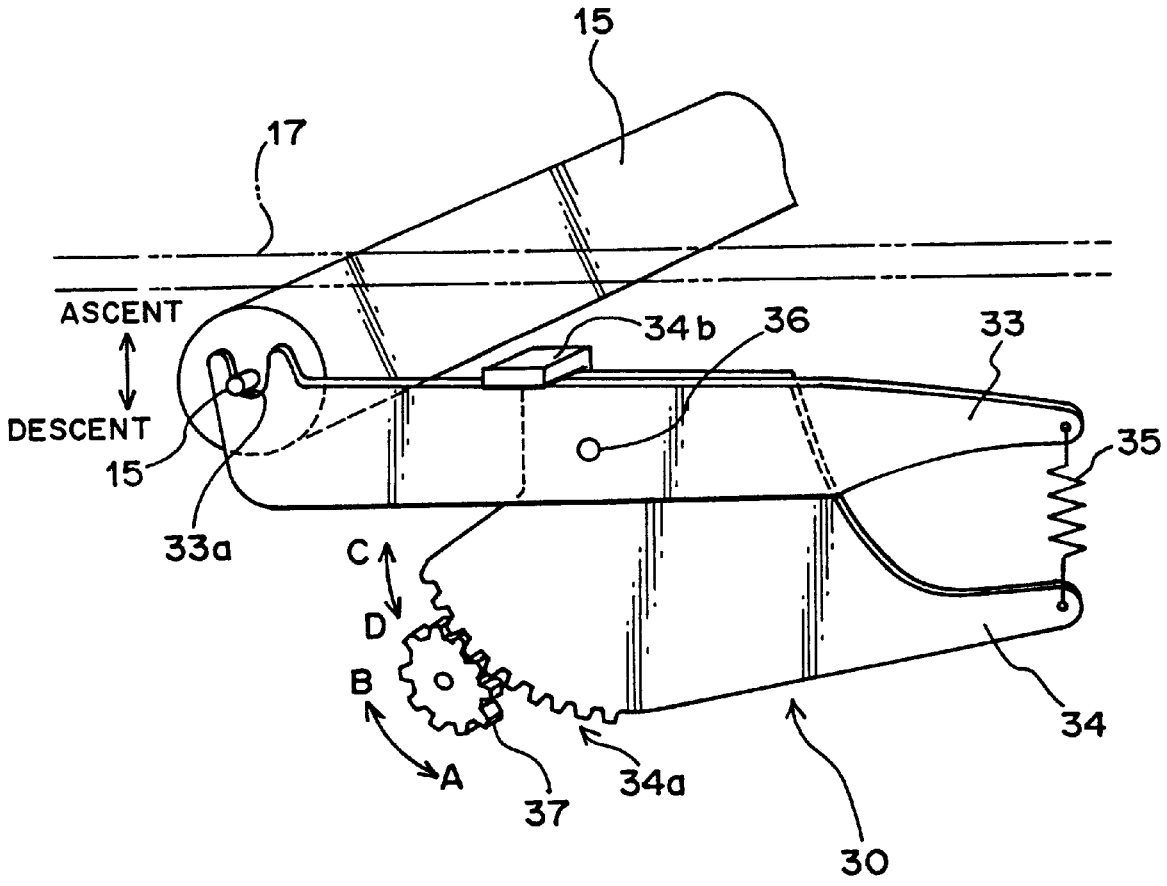
FIG. 3 is a perspective view schematically showing the structure of the switching mechanism according to the present embodiment.
Figure 4:
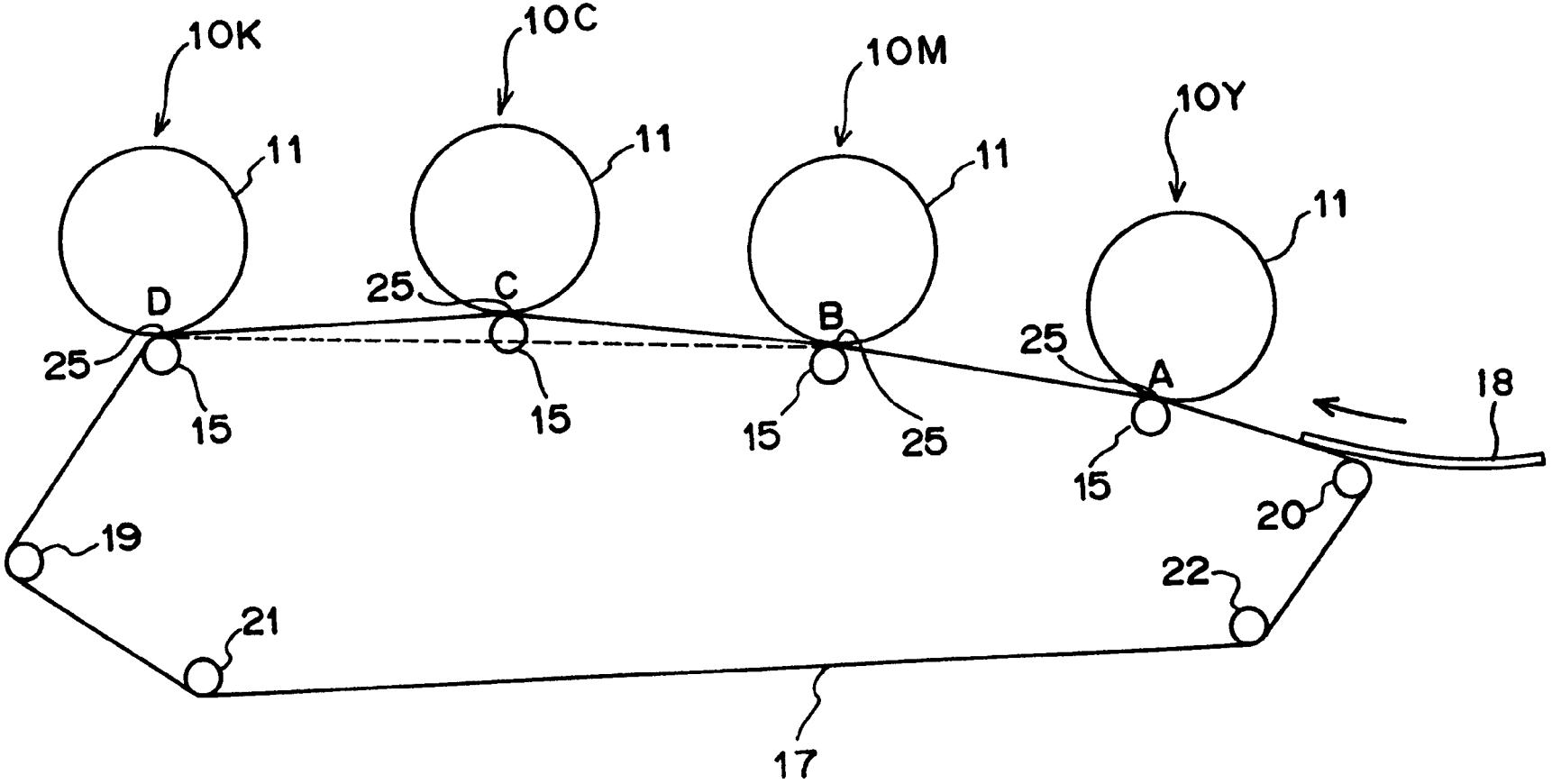
FIGS. 4 and 5 are side sectional views schematically showing the conveying system to illustrate the operation of the switching mechanism according to the present embodiment.
Figure 5:
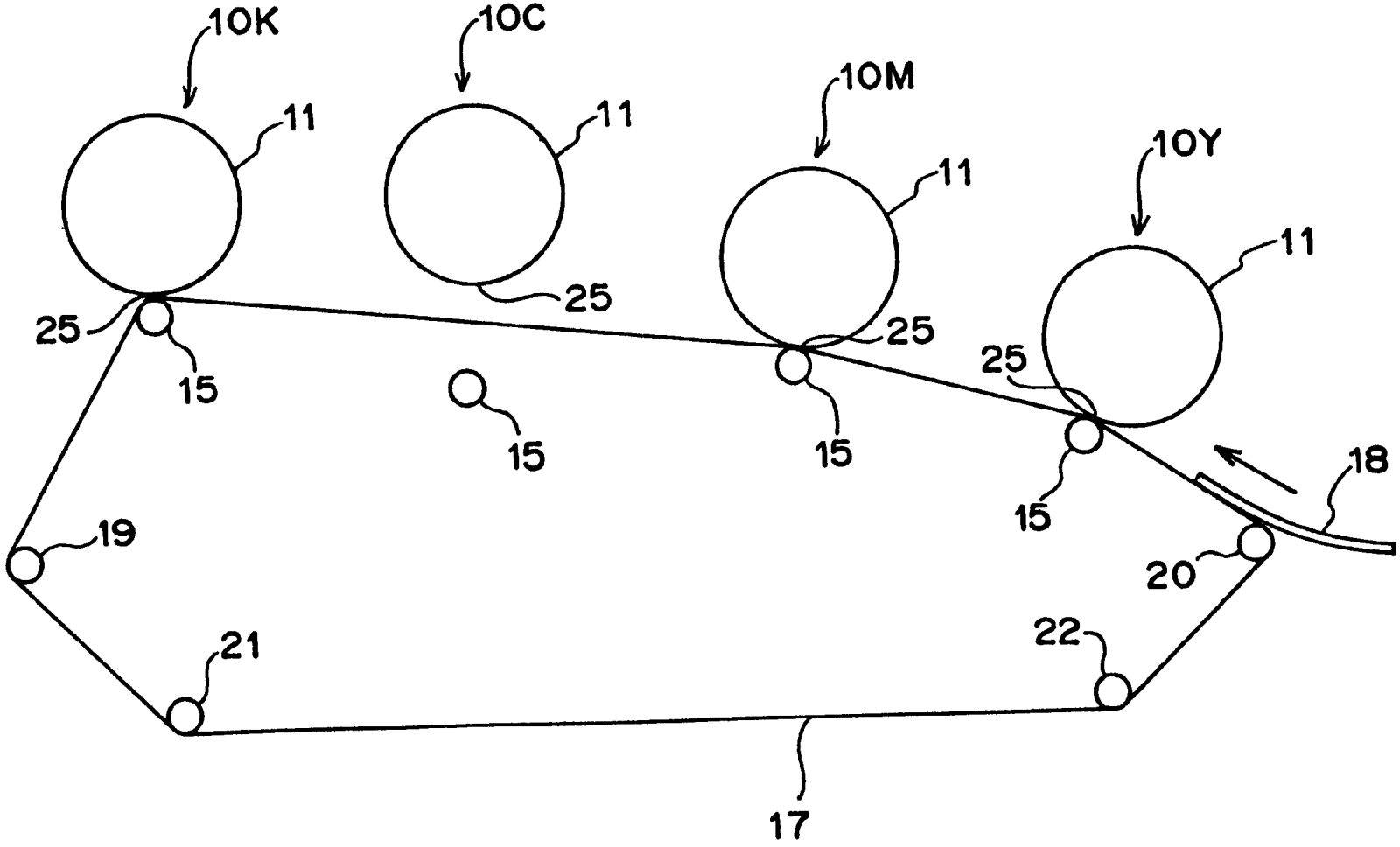

FIGS. 2 to 5 show a color image forming device (electrophotographic printer) according to an embodiment of the present invention. FIG. 2 is a side-sectional view schematically showing the internal structure. FIG. 3 is a perspective view schematically showing the structure of the switching mechanism. FIGS. 4 and 5 are side sectional views each schematically showing the conveying system used for explaining the operation of the switching mechanism. FIG. 1 is a diagram used for explaining the method of deciding positions of image transfer points in a color image forming device according to the present embodiment.

In the present embodiment, the case where the present invention is applied to the electro-photographic printer will be described below. As depicted in FIG. 2, the electro-photographic printer 1A of the present embodiment has nearly the same configuration as the electro-photographic printer 1 described with FIG. 6. The explanation on the printer 1A according to the present embodiment is made by referring to FIGS. 1 to 5 and by extracting the main portion (the feature of the present invention). In FIGS. 1 to 5, like numerals are represented to the same elements as those before-explained with FIG. 6. The detail explanation will be omitted here.

Figure 6:
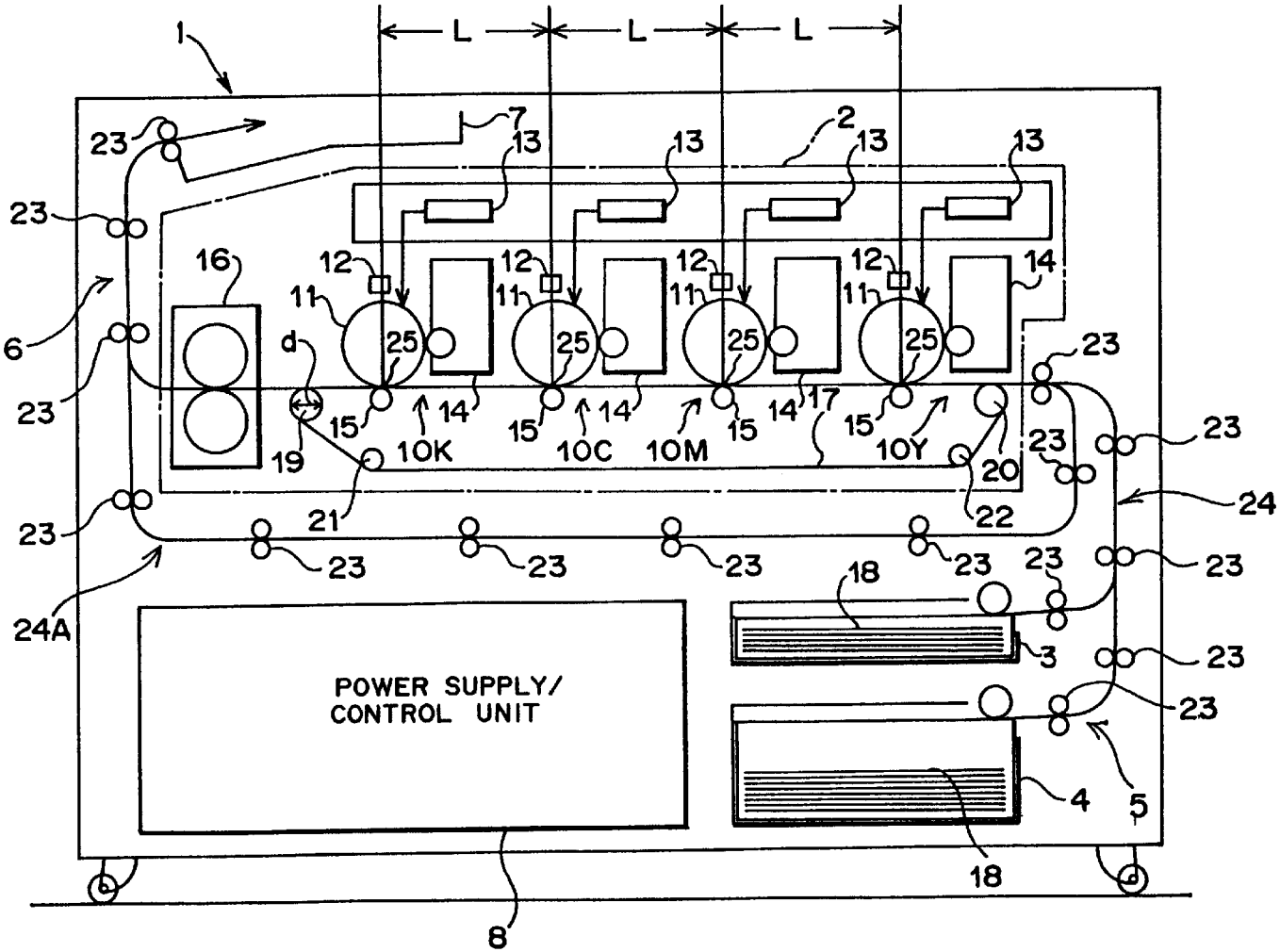
FIG. 6 is a side sectional view schematically showing the internal structure of a general color image forming device.
Figure 7:
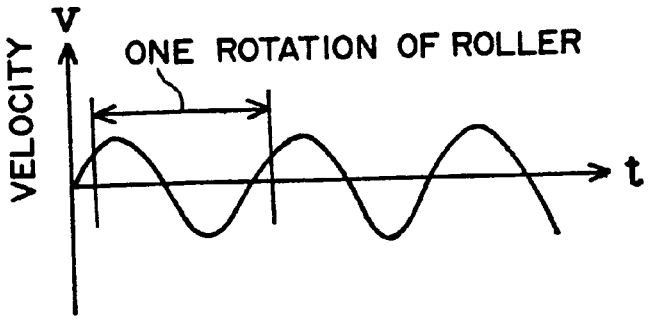
FIG. 7 is a graph showing the periodicity of a variation in velocity of a transfer belt (conveying belt)

The printer 1A of the present embodiment differs from the printer 1 shown in FIG. 6 in three points including that the transfer belt 17 is arranged so as to draw the conveying path of the transfer paper sheet 18 in a slow arc (curved form) and that each of the printing units 10Y, 10M, 10C and 10K includes the switching mechanism 30 and that the position of the image transfer point 25 (A to D) in each of the printing units 10Y, 10M, 10C and 10K is decided and arranged according to the technique (to be described later with FIG. 1). The three differences will be described below in detail.

In the printer 1A of the present embodiment, in order to achieve the prolonged serviceable life of a printing unit which is not very frequently used, reduced power consumption and stain prevention of remaining toner, the transfer roller 15 in each of the printing units 10Y, 10M, 10C and 10K is arranged vertically (in the direction in contact with or separated from the photosensitive body 11) and movably. The transfer rollers 15 are also arranged such that the image transfer points 25 in the use state of all the printing units 10Y, 10M, 10C and 10K draw a gentle arc (curved form).

In each of the printing units 10Y, 10M, 10C and 10K, the positions A to D of the points (image transfer points) 25 each at which an image is transferred on the transfer paper sheet 18 by means of the photosensitive body 11 and the transfer roller 15 are arranged in parallel, with different heights with respect to the horizontal plane. Thus, the transfer points are arranged so as to make the conveying route (that is, the transfer belt 17) of the transfer paper sheet 18 in an arc form.

In each of the printing units 10Y, 10M, 10C and 10K, the switching mechanism 30 switches a state of each of the printing units 10Y, 10M, 10C and 10K to either a contact state (refer to FIG. 4) in which printing is made at the image transfer point 25, with the photosensitive body 11 in contact with the transfer paper sheet 18, or a separate state (refer to FIG. 5) in which printing is not made by the printing unit because the transfer paper sheet 18 is separated off from the image transfer point 25, together with the transfer belt 17 being a conveying path. In concrete, the switching mechanisms 30 are mounted as shown in FIG. 3.

Hence, in a printing unit for an unused color component, the transfer paper sheet 18 and the transfer belt 17 can be separated from the photosensitive body 11 by moving the transfer roller 15 by means of the switching mechanism 30 in the direction (downward) separating from the photosensitive body 11. Thus, the state can be made where the transfer paper sheet 18 becomes in non-contact with the photosensitive body 11.

For example, if the printing unit 10C is not used, in the color image printing state in which all the printing units 10Y, 10M, 10C and 10K are used as shown in FIG. 4, the transfer roller 15, as shown in FIG. 5, is moved downward by operating the switching mechanism 30 in the printing unit 10C.

In this operation, the transfer belt 17 suspended in an arc form is separated from the photosensitive body 11 (the image transfer point 25 at the position C) in the printing unit 10C. Then the transfer paper sheet 18 passes through the printing unit 10C without contacting with the photosensitive body 11.

In this case, the conveying path (transfer belt 17) between the image transfer point 25 of the printing unit 10M and the image transfer point 25 of the printing unit 10K arranged after and before the printing unit 10C changes its shape from an arc shown in FIG. 4 passing through the points B, C and D to a straight line shown in FIG. 5 extending from the point B to the point D.

In FIGS. 4 and 5, the switching mechanism 30 is not illustrated.

The configuration of the switching mechanism 30 will be described in detail by referring to FIG. 3. As shown in FIG. 3, the switching mechanism 30 hoists and lowers the transfer roller 15 in each of the printing units 10Y, 10M, 10C and 10K, and is composed of a pair of upper levers 33, a pair of lower levers 34, a pair of springs 35, and a pair of drive gears 37 arranged on both ends of the transfer roller 15, respectively. FIG. 3 shows only one side of the mechanism.

The upper lever 33 and the lower lever 34 are mounted on the main body (e.g. a cabinet not shown) of the printer 1A so as to be coupled mutually and rotatably by means of the connection pin 36. A bearing unit 33*a* which supports the rotational axis 15*a* rotatably at the end of the transfer roller 15 is formed on an end of the upper lever 33.

Another end of the upper lever 33 is coupled to an end of the lower lever 34 via the spring 35. The spring 35 presses the transfer roller 15 via the upper lever 33 into the photosensitive body 11. When the transfer paper sheet 18 is fed between the photosensitive body 11 and the transfer roller 15 along the transfer belt 17, the upper lever 33 rotates around a connection pin 36 against the force of the spring 35 so that the transfer roller 15 is lowered somewhat. This operation can absorb the thickness of the transfer paper sheet 18.

A stopper 34*b* is formed on the lower lever 34. The stopper 34*b* is formed so as to contact to the upper surface of the upper lever 33. The connection pin 36 is aranged between the stopper 34*b* and the spring 35. Since the stopper 34*b* is in contact with the upper lever 33, it regulates the rotation of the upper lever 33 caused by the force of the spring 35. As a result, it is suppressed that the transfer roller 15 is excessively pressed to the photosensitive body 11.

The lower outer fringe of the lower lever 34 is formed in an arc form, with its center being the connection pin 36. A rack 34*a* meshed with the drive gear 37 is formed on the arc outer fringe.

The drive gear 37 is rotatably driven in the direction A or B by means of a pulse motor (not shown). The whole system of the transfer roller 15, the upper lever 33, the lower lever 34 and the spring 35 rotates in the direction C or D and around the connection pin 36 by means of the rotational drive force of the gear 37. This operation allows the transfer roller 15 to be driven upward and downward.

In the switching mechanism 30, when the drive gear 37 rotates in the direction B, the lower lever 34 rotates in the direction D. At the same time, the upper lever 33 rotates in the direction D while being in contact with the stopper 38. In this operation, the transfer roller 15 is lowered to separate off from the photosensitive body 11. Thus, each of the printing units 10Y, 10M, 10C and 10K becomes its separated state (refer to FIG. 5) where the transfer paper sheet 18 separates off from the image transfer point 25.

As the drive gear 37 rotates in the direction A, the lower lever 34 rotates in the direction C while the upper lever 33 rotates in the direction C with the bias force of the spring 35. In this operation, when the transfer roller 15 is driven upward to the predetermined position where it is pressed against the photosensitive body 11 by a suitable force, each of the printing units 10Y, 10M, 10C and 10K becomes its contact state (refer to FIG. 4) where the photosensitive body 11 performs its printing operation at the image transfer point 25 with the transfer paper sheet 18 contacted thereto.

In this case, in the printing unit 10Y, 10M, 10C or 10K in a separated state, since the developing unit 14 and the photosensitive body 11 are separated from the transfer belt (conveying path) 17, it is not needed to stir the developer in the developing unit 14 and to rotate the photosensitive body 11 at a printing operation. This operation prevents the photosensitive body 11 in a printing unit with a low frequency of use from being wasted and the remaining toner from being stained. This operation also prevents the developer used in the printing unit from being deteriorated and prolongs the serviceable life of the printing unit with a small use frequency. Further, the power consumption can be reduced.

When the switching mechanism 30 lowers the transfer roller 15 in an unused printing unit and thus separates off the transfer belt 17 from the photosensitive body 11, the conveying path (transfer belt 17) between the image transfer points 25 and 25 of the printing units arranged after and before the unused printing unit, as shown in FIG. 5, changes its state from an arc to a straight line, so that the distance between the image transfer points 25 and 25 varies.

For example, in comparison with the conveying path shown with solid lines in FIG. 4 and the conveying path shown in FIG. 5, all four transfer rollers 15 are arranged so as to be in contact with the photosensitive bodies 11 (image transfer points 25), respectively, as shown in FIG. 4, while in FIG. 5 only the transfer roller 15 in the printing unit 10C is arranged so as to be separated from the photosensitive body 11.

Now, it is assumed that the conveying path length ranging from the position B to the position C and the conveying path length extending from the position B to the position D via the position C shown in FIG. 4 are respectively set to an integral multiple of the reference length corresponding to the velocity variation period of the drive system (drive roller 19) in the conveying mechanism (transfer belt 17). In this case, when the transfer roller 15 in the printing unit 10C, as shown in FIG. 5, is separated from the photosensitive body 11, the conveying path length directly extending from the position B to the position D without passing the position C deviates largely from an integral multiple of the reference length. As a result, a shift in transfer position due to the velocity variation may cause the color separation. It is very difficult to adjust the conveying path length directly extending from the position B to the position D shown in FIG. 5 to an integral multiple of the reference length. This difficulty imposes large restriction to determine the transfer interval (the interval between photosensitive bodies) or the diameter of the drive roller 19.

In the electro-photographic printer 1A of the present embodiment, the positions A to D of the image transfer points 25 in the printing units 10Y, 10M, 10C and 10K are determined by the technique described below with FIG. 1.

In FIG. 1, the image transfer points 25 in the printing units 10Y and 10K are arranged at the same height $y_0$ (the position in the direction Y) and the image transfer points 25 in the printing units 10M and 10C are arranged at the same height $y_1$. The positions $y_0$ and $y_1$ are determined previously. Here, it is assumed that the position $y_1$ is higher than the position $y_0$ by the value h.

For the brief explanation, the conveying path linking the image transfer points 25 shown in FIG. 1 is a straight line. In actual, it is needed to consider the curvature of the transfer roller 15 being in contact with the transfer belt 17. However, since the curvature can be ignored, the conveying path is treated as a straight line in the present embodiment.

In the printing units 10Y, 10M, 10C and 10K shown in FIG. 1, the positions of the image transfer points 25 determined by the technique according to the present embodiment are represented with the symbols A, B, C and D. The reference length is represented by the symbol $L_0$.

The position A of the image transfer point 25 of the printing unit 10Y which is arranged on the most upper side in the conveying path is suitably decided. The positions B to D of the image transfer points 25 arranged on the lower side are decided sequentially with respect to the position A acting as the reference point.

The position B of the image transfer point 25 of the printing unit 10M is decided such that the straight distance from the position A is twice the reference length $L_0$ at the height position $y_1$.

Next, the procedure of determining the position C of the image transfer point 25 in the printing unit 10C will be described. First, the virtual position or arrangement area is decided near the position at which the image transfer point 25 is arranged. Here, the arrangement area of the image transfer point 25 is determined, for example, at the height $y_1$ and near the position twice the reference length $L_0$ apart in the direction x from the position B.

Of the conveying paths reaching the arrangement area from the positions A and B previously determined, the shortest conveying path is obtained for each of the positions A and B according to the on or off state switched by means of the switching mechanism 30. As shown in FIG. 1, the shortest conveying path originating from the position A corresponds to the straight line extending from the position A to the arrangement area. The shortest conveying path from the position B corresponds to the straight line extending from the position B to the arrangement area.

Thereafter, at the height $y_1$ within the arrangement area, a position of a point, which each shortest conveying path from the position A or B reaches, is obtained so that each shortest conveying path length is equal to an integral multiple of the reference length $L_0$. In the example shown in FIG. 1, the conveying path extending from the position A to the position $A_1$ corresponds to the conveying path length four times the reference length $L_0$ while the conveying path extending from the position B to the position $B_1$ corresponds to the conveying path length twice the reference length $L_0$.

The position C of the image transfer point 25 in the printing unit 10C is determined as the midpoint between the positions $A_1$and $B_1$.

Next, the procedure of determining the position D of the image transfer point 25 in the printing unit 10K is explained. Like the case where the position C of the image transfer point 25 in the printing unit 10C, the virtual position or arrangement area is first determined near the position where the image transfer point 25 is set. For example, the area spaced from the position C approximately twice the reference length $L_0$ at the height $y_0$ is previously determined as an arrangement area for the image transfer point 25.

Of the conveying paths which arrive at the arrangement area from the previously-decided positions A, B and C, the shortest conveying path is obtained at each of the positions A to C according to the on or off state switched by the switching mechanism 30. As shown in FIG. 1, the shortest conveying path from the position A is the straight line extending from the position A to the arrangement area. The shortest conveying path extending from the position B is the straight line extending from the position B to the arrangement area. The shortest conveying path extending from the position C is the straight line extending from the position C to the arrangement area.

Thereafter, at the height $y_0$ within the arrangement area, a position of a point, which each shortest conveying path from the position A, B or C reaches, is obtained so that each shortest conveying path length is equal to an integral multiple of the reference length $L_0$. In the example shown in FIG. 1, the conveying path extending from the position A has the conveying path length six times of the reference length $L_0$ and reaches the position $A_2$. The conveying path extending from the position B has the conveying path length four times of the reference length $L_0$ and reaches the position $B_2$. The conveying path from the position C has the conveying path length twice of the reference length $L_0$ and reaches the position $C_2$.

The position D of the image transfer point 25 in the printing unit 10K is decided according to the positions $A_2$, $B_2$ and $C_2$. For example, the average of three positions $A_2$, $B_2$ and $C_2$ is determined as the position D.

The position D may be decided by weighting three positions $A_2$, $B_2$ and $C_2$, as shown below. As shown in FIG. 1, by assuming that the known distance between the positions $B_2$ and $C_2$ is $L_{BC}$, that the known distance between the positions $A_2$ and $B_2$ is $L_{AB}$, that the unknown distances between the distance D to be decided and the positions $A_2$, $B_2$ and $C_2$ are $X_A$, $X_B$ and $X_C$ respectively, and that weights to the positions $A_2$, $B_2$ and $C_2$, are $m_A$, $m_B$ and $m_C$ respectively, the position D can be decided by solving the following three dimensional linear simultaneous equations.

$$m_A \cdot X_A = m_B \cdot X_B + m_B \cdot X_C$$

$$X_A = L_{AB} - X_B$$

$$X_C = L_{BC} + X_B$$

When the position D is decided as the distance $X_B$ from the position $B_2$, the equation, $X_B=(m_A \cdot L_{AB}-m_C \cdot L_{BC})/(m_A+m_B+m_C)$, is held by solving the above equations.

If $m_A=m_B=m_C$, $X_B=(L_{AB}-L_{BC})/3$, or the average position of three positions $A_2$, $B_2$ and $C_2$ becomes the position D. In the printer 1A, for example, which is often used without using the printing unit 10C, the position D is determined near the position $B_2$ by setting the weight $m_B$ to the arrival position $B_2$ from the position B to a value larger than the other weights $m_A$ or $m_C$.

Referring to FIG. 1, when the position C is decided as the midposition between the positions $A_1$ and $B_1$, the position C may be decided by weighting the positions $A_1$ and $B_1$.

Figure 8:
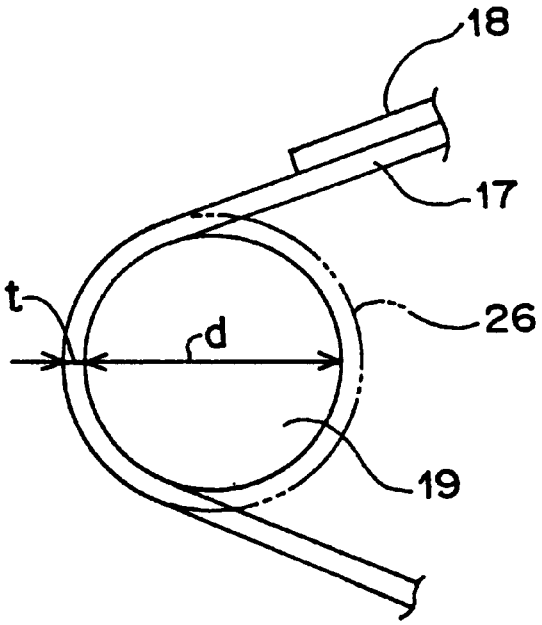
FIG. 8 is a diagram showing a virtual circle in consideration of the thickness of a transfer belt (conveying belt) wound around a drive roller.

When it is assumed that the drive roller 19 has a diameter of d and the conveying belt has a thickness of t, either the peripheral length $\pi d$ of the drive roller 19 or $\pi(d+2t)$ may be used as the reference length $L_0$. Strictly speaking, the period of the velocity variation of the drive roller 19 is actually not the peripheral length $\pi d$ of the drive roller 19. As before-described with FIG. 8, the period corresponds to the peripheral length $\pi(d+2t)$ of the virtual circle 26, by considering the thickness t of the transfer belt 17 wound around the drive roller 19. Hence, the transfer position of the toner image transferred at the image transfer point can be surely prevented from being shifted, by setting the reference length $L_0$ to an integral multiple of the peripheral length $\pi(d+2t)$ of the virtual circle 26.

As described above, according to the embodiment of the present invention, the image transfer points 25 of the printing units 10Y, 10M, 10C and 10K are respectively arranged at the above-decided positions A to D. Thus, whichever printing unit become in an unused mode by the operation of the switching mechanism 30, the position of the image transfer point 25 of a printing unit which is in a use mode is set corresponds to nearly the position an integral multiple of the reference length $L_0$ away from the other image transfer points 25 which are in a used mode.

Therefore, even when the interval between transfer points is varied according to the use or unused mode of the printing units 10Y, 10M, 10C or 10K, the occurrence of the transfer positional shift associated with the velocity variation of the drive system can be suppressed as low as possible. As a result, the print quality of a color image can be reserved by reducing the occurrence of the color shift while the prolonged serviceable life of the printing unit which is not very frequently used, reduced power consumption, and the prevention of the residue toner stain are achieved.

In the above-mentioned embodiment, the method of determining the positions of four image transfer points 25 has been explained. However, it should be noted that the present invention is not limited only to the embodiment. Like the above-mentioned embodiment, the present invention can be applied to the color image forming devices including at least three printing units. Thus, the same function and effect as those in the above-mentioned embodiment can be obtained.

In the above-mentioned embodiment, twice, four times and six times have been selected as an integral multiple of the reference length $L_0$. However, the present invention should not be limited only to the values.

Further, in the method of deciding the image transfer point 25 as shown in FIG. 1, the case where four image transfer points 25 occupy the height $y_0$ or $y_1$ and the positions in the x-direction of the positions C and D are decided has been explained. However, it should be noted that the present invention is not limited only to that condition. Like the above-mentioned embodiment, the present invention can be applied when the image transfer points 25 are arranged in a gentle arc (curved) form while the printing unit can be changed in an unused mode by lowering the transfer roller 15 by means of the switching mechanism 30.

What is claimed is:

1. An image transfer point deciding method suitable for a color image forming device, said color image forming device including:

plural printing units for performing printing of each color on a sheet-like medium by transferring a developed image onto said sheet-like medium at an image transfer point to form a color image on said sheet-like medium by overlapping plural colors; and a conveying mechanism for conveying said sheet-like medium along the conveying path continuously formed so as to pass through said image transfer points in said plural printing units, to perform a continuous printing operation onto said sheet-like medium by means of each of said printing units;

each of said printing units including a switching mechanism which switches a state of each of said printing units to a contact state in which said printing unit performs printing at said image transfer point, while being in contact with said sheet-like medium, or to a separation state in which said printing unit does not perform printing, while said sheet-like medium being separated off from said image transfer point, together with said conveying path;

said image transfer point deciding method comprising the steps of:

deciding a position of a first image transfer point and a position of a second image transfer point on the upper side of said conveying path so that the conveying path length between the first image transfer point and the second image transfer point is equal to an integral multiple of a reference length corresponding to a velocity variation period of a drive system in said conveying mechanism; and sequentially deciding a position of each of image transfer points of said conveying path being on the lower side than the second image transfer point according to the following procedures (1) to (4) from the upper side of said conveying path;

(1) deciding a temporary position or arrangement area of an i (≧3) -th image transfer point from the upper side of said conveying path;

(2) deciding the conveying path most-shortened according to the contact or separation state switched by said switching mechanism for each of the first to (i−1)-th image transfer points, among conveying paths which extend from each of the first to (i−1)-th image transfer points to said temporary position or said arrangement area;

(3) deciding a position of a point near said temporary point or within said arrangement area which the shortest conveying path from each of the first to (i−1)-th image transfer points obtained in the step (2) reaches so that the shortest conveying path length is equal to an integral multiple of said reference length; and (4) deciding the position of the i-th image transfer point based on the positions of the (i−1) points obtained in the step (3).

2. The image transfer point deciding method suitable for said color image forming device according to claim 1, wherein said conveying mechanism comprises a conveying belt which is driven by means of a drive roller while said sheet-like medium is mounted thereon; and wherein said reference length is a peripheral length of said drive roller.

3. The image transfer point deciding method suitable for said color image forming device according to claim 1, wherein said conveying mechanism comprises a conveying belt which is driven by means of a drive roller while said sheet-like medium is mounted thereon; and wherein said reference length is $\pi(d+2t)$, where d is a diameter of said drive roller and t is a thickness of said conveying belt.

4. A color image forming device including:

plural printing units for performing printing of each color on a sheet-like medium by transferring a developed image onto said sheet-like medium at an image transfer point to form a color image on said sheet-like medium by overlapping plural colors; and conveying mechanism for conveying said sheet-like medium along the conveying path continuously formed so as to pass through said image transfer points in said plural printing units, to perform a continuous printing operation onto said sheet-like medium in each of said printing units;

each of said printing units including a switching mechanism which switches a state of each of said printing units to a contact state in which said printing unit performs printing at said image transfer point, while being in contact with said sheet-like medium, or to a separation state in which said printing unit does not perform printing, while said sheet-like medium being separated off from said image transfer point, together with said conveying path;

a first image transfer point and a second image transfer point on the upper side of said conveying path being arranged so that the conveying path length between the first image transfer point and the second image transfer point is equal to an integral multiple of a reference length corresponding to a velocity variation period of a drive system in said conveying mechanism; and each of image transfer points of said conveying path on the lower side than the second image transfer point being arranged to positions sequentially decided according to the following procedures (1) to (4) from the upper side of said conveying path;

(1) deciding a temporary position or arrangement area of an i (≧3) -th image transfer point from the upper side of said conveying path;

(2) deciding the conveying path most-shortened according to the contact or separation state switched by said switching mechanism for the first to (i−1)-th image transfer points, among conveying paths which extend from the first to (i−1)-th image transfer points to said temporary position or said arrangement area;

(3) deciding a position of a point near said temporary point or within said arrangement area which the shortest conveying path from each of the first to (i−1)-th image transfer points obtained in the step (2) reaches so that the shortest conveying path length is equal to an integral multiple of said reference length; and (4) deciding the position of the i-th image transfer point based on the positions of the (i−1) points obtained in the step (3).

5. The color image forming device according to claim 4, wherein said conveying mechanism comprises a conveying belt which is driven by means of a drive roller while said sheet-like medium is mounted thereon; and wherein said reference length is a peripheral length of said drive roller.

6. The color image forming device according to claim 4, wherein said conveying mechanism comprises a conveying belt which is driven by means of a drive roller while said sheet-like medium is mounted thereon; and wherein said reference length is $\pi(d+2t)$, where d is a diameter of said drive roller and t is a thickness of said conveying belt.

* * * * *